US008527100B2

(12) United States Patent
Russell et al.

(10) Patent No.: US 8,527,100 B2
(45) Date of Patent: Sep. 3, 2013

(54) METHOD OF PROVIDING A FLOW CONTROL DEVICE THAT SUBSTANTIALLY REDUCES FLUID FLOW BETWEEN A FORMATION AND A WELLBORE WHEN A SELECTED PROPERTY OF THE FLUID IS IN A SELECTED RANGE

(75) Inventors: Ronnie D. Russell, Cypress, TX (US); Luis A. Garcia, Houston, TX (US); Gonzalo A. Garcia, Katy, TX (US); Eddie G. Bowen, Porter, TX (US); Sudiptya Banerjee, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 327 days.

(21) Appl. No.: 12/630,546

(22) Filed: Dec. 3, 2009

(65) Prior Publication Data

US 2011/0079387 A1 Apr. 7, 2011

Related U.S. Application Data

(60) Provisional application No. 61/248,346, filed on Oct. 2, 2009.

(51) Int. Cl.

| | |
|---|---|
| ***G05D 7/00*** | (2006.01) |
| ***G06F 17/50*** | (2006.01) |
| ***G06F 7/60*** | (2006.01) |
| ***G01N 15/08*** | (2006.01) |
| ***G01F 1/00*** | (2006.01) |
| ***E03B 3/18*** | (2006.01) |
| ***E21B 43/00*** | (2006.01) |
| ***E21B 33/12*** | (2006.01) |

(52) U.S. Cl.

USPC ..... 700/282; 703/1; 703/2; 702/12; 702/45; 166/228; 166/369; 166/386

(58) Field of Classification Search

USPC ..... 700/282; 702/12, 45; 166/228, 166/369, 386; 703/1, 2

See application file for complete search history.

(56) References Cited

U.S. PATENT DOCUMENTS

| | | | | |
|---|---|---|---|---|
| 5,803,179 | A | 9/1998 | Echols et al. | |
| 5,896,928 | A | 4/1999 | Coon | |
| 6,112,815 | A | 9/2000 | Boe et al. | |
| 6,112,817 | A | 9/2000 | Voll et al. | |
| 7,290,606 | B2 | 11/2007 | Coronado et al. | |
| 7,409,999 | B2 | 8/2008 | Henriksen et al. | |
| 7,469,743 | B2 | 12/2008 | Richards | |
| 7,789,145 | B2 * | 9/2010 | Patel | 166/278 |
| 7,857,050 | B2 | 12/2010 | Zazovsky et al. | |
| 2002/0049575 | A1 * | 4/2002 | Jalali et al. | 703/10 |
| 2002/0177955 | A1 * | 11/2002 | Jalali et al. | 702/9 |
| 2006/0064288 | A1 * | 3/2006 | Ferryanto et al. | 703/2 |
| 2007/0169942 | A1 | 7/2007 | Loretz et al. | |
| 2007/0246407 | A1 | 10/2007 | Richards et al. | |
| 2008/0041581 | A1 | 2/2008 | Richards | |
| 2008/0314590 | A1 | 12/2008 | Patel | |
| 2009/0084448 | A1 | 4/2009 | Lowery | |
| 2009/0095468 | A1 * | 4/2009 | Augustine et al. | 166/250.01 |
| 2009/0095487 | A1 * | 4/2009 | Xu et al. | 166/373 |
| 2009/0101341 | A1 * | 4/2009 | Willauer | 166/250.15 |
| 2009/0133874 | A1 | 5/2009 | Dale et al. | |
| 2009/0205834 | A1 * | 8/2009 | Garcia et al. | 166/373 |
| 2009/0218103 | A1 | 9/2009 | Aakre et al. | |
| 2011/0079387 | A1 | 4/2011 | Russell et al. | |

FOREIGN PATENT DOCUMENTS

GB 2356879 A 6/2001

OTHER PUBLICATIONS

Coronado et al. (New Inflow Control Device Reduces Fluid Viscosity Sensitivity and Maintains Erosion Resistance, OTC, May 4, 2009).*

Lea et al., Production Optimization Using a Computerized Well Model, SPE, 1986.*

Stanley, Propulsion System Design Optimization Using the Taguchi Method, IEEE, 1993.*

Garcia et al.; "Identifying Well Completion Applications for Passive Inflow Control Devices," SPE 124349, 2009 SPE Annual Technical Conference and Exhibition, New Orleans, Louisiana, Oct. 4-7, 2009, pp. 1-19.

International Search Report and Written Opinion dated Oct. 23, 2012 for International Application No. PCT/US2012/033248; all references cited above.

* cited by examiner

*Primary Examiner* — Kavita Padmanabhan
*Assistant Examiner* — Darrin Dunn
(74) *Attorney, Agent, or Firm* — Cantor Colburn LLP

(57) ABSTRACT

A method of providing a flow control device is disclosed, which one aspect may include: defining a flow rate; defining a desired relationship between a parameter of the flow control device that exhibits a substantial change when a selected property of the fluid changes in a first range and remains substantially constant when the selected property is in the second range; determining using a computer and a simulation program the relationship between the performance parameter and the selected property over the first range and the second range for the defined flow rate for a geometry of a flow through area of a flow control device; comparing the determined relationship of the performance parameter with the desired relationship; altering the geometry to a new geometry when the difference between the desired performance and the determined performance is outside a desired range; determining using the computer and the simulation program the relationship between the performance parameter and the selected property over the first range and the second range for the defined flow rate for the new geometry of the flow through area of the flow control device; repeating the process of altering the geometry and determining the performance until the difference between the desired performance and the determined performance for a geometry is acceptable; and storing the geometry of the flow through device on a suitable storage medium for which the difference between the determined performance and the desired performance is acceptable.

19 Claims, 11 Drawing Sheets

METHOD OF PROVIDING A FLOW CONTROL DEVICE THAT SUBSTANTIALLY REDUCES FLUID FLOW BETWEEN A FORMATION AND A WELLBORE WHEN A SELECTED PROPERTY OF THE FLUID IS IN A SELECTED RANGE

CROSS-REFERENCE TO RELATED APPLICATION

This application takes priority from U.S. Provisional Application Ser. No. 61/248,346, filed on Oct. 2, 2009.

BACKGROUND OF THE DISCLOSURE

1. Field of the Disclosure

The disclosure relates generally to apparatus and methods for control of fluid flow from subterranean formations into a production string in a wellbore.

2. Description of the Related Art

Hydrocarbons such as oil and gas are recovered from a subterranean formation using a well or wellbore drilled into the formation. In some cases the wellbore is completed by placing a casing along the wellbore length and perforating the casing adjacent each production zone (hydrocarbon bearing zone) to extract fluids (such as oil and gas) from such a production zone. In other cases, the wellbore may be open hole. One or more inflow control devices are placed in the wellbore to control the flow of fluids into the wellbore. These flow control devices and production zones are generally separated from each other by installing a packer between them. Fluid from each production zone entering the wellbore is drawn into a tubing that runs to the surface. It is desirable to have a substantially even flow of fluid along the production zone. Uneven drainage may result in undesirable conditions such as invasion of a gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil.

A deviated or horizontal wellbore is often drilled into a production zone to extract fluid therefrom. Several inflow control devices are placed spaced apart along such a wellbore to drain formation fluid or to inject a fluid into the formation. Formation fluid often contains a layer of oil, a layer of water below the oil and a layer of gas above the oil. For production wells, the horizontal wellbore is typically placed above the water layer. The boundary layers of oil, water and gas may not be even along the entire length of the horizontal well. Also, certain properties of the formation, such as porosity and permeability, may not be the same along the well length. Therefore, fluid between the formation and the wellbore may not flow evenly through the inflow control devices. For production wellbores, it is desirable to have a relatively even flow of the production fluid into the wellbore and also to inhibit the flow of water and gas through each inflow control device. Active flow control devices have been used to control the fluid from the formation into the wellbores. Such devices are relatively expensive and include moving parts, which require maintenance and may not be very reliable over the life of the wellbore. Passive inflow control devices ("ICDs") that are able to restrict flow of water and gas into the wellbore are therefore desirable.

The disclosure herein provides passive ICDs that in one aspect restrict the flow of fluids having undesired viscosities or densities and in another aspect maintain a substantially constant flow of fluids having desired viscosities or densities.

SUMMARY

In one aspect, the disclosure provides a flow control device for controlling flow of a fluid between a formation and a wellbore. The flow control device in one embodiment may include an inflow region, a flow-through region and an outflow region, wherein the flow-through region is configured to substantially increase pressure drop when viscosity or density of the fluid is in a first range and maintain a substantially constant pressure drop when the viscosity or density of the fluid is in a second. In another embodiment, the flow-through region may include a structural flow area, an inflow opening and an outflow opening, wherein the structural flow area, a fluid flow path in the structural flow area, tortuosity of the fluid flow path and size of the outflow opening are selected so that values of pressure loss coefficient ("K") are substantially higher for fluids having Reynolds number ("Re)" in a first range compared to fluids having Re in a second range.

In another aspect, a method of making a flow control device for use in a wellbore for controlling flow of a fluid from a formation into the wellbore is provided. The method, in one embodiment, may include: defining a flow rate for the fluid inflow control device; selecting a geometry for a flow-through region of the flow control device sufficient to cause a pressure drop across the flow-through region that is substantially greater for fluids having viscosity or density in a first range compared to fluids having viscosity or density in a second range for the defined flow rate; and forming the flow control device having the selected geometry.

In yet another aspect, the disclosure herein provides a computer-readable medium, accessible to a processor, having embedded thereon a computer program for executing instructions contained in the computer program, the computer program including: (a) instructions to access a flow rate for a flow control device; (b) instructions to access a first geometry for a flow-through region of the flow control device formed on a tubular member, the flow-through region including an inlet, an outlet and a tortuous path between the inlet and the outlet configured to induce turbulence in the flow of the fluid between the inlet and the outlet sufficient to reduce an effective flow area of the outlet to cause a pressure drop across the outlet that is substantially greater for fluids having viscosity or density in a first range compared to fluids having viscosity or density in a second range for the defined flow rate; instructions to compute pressure drops across the outlet based on the first geometry corresponding to a plurality of fluid viscosities or fluid densities; (c) instructions to determine if the computed pressure drops are acceptable; (d) instructions to selected a different geometry when the computed pressure drops are not acceptable and repeating (b) and (c) using the different geometry until the pressure drops are acceptable; and (e) storing the geometry for which the pressure drops are acceptable.

Examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters designate like or similar elements throughout the several figures of the drawing, and wherein.

DETAILED DESCRIPTION OF THE DISCLOSURE

The present disclosure relates to apparatus and methods for controlling flow of formation fluids in a well. The present disclosure provides certain drawings and describes certain embodiments of the apparatus and methods, which are to be considered exemplification of the principles described herein and are not intended to limit the disclosure to the illustrated and described embodiments.

Figure 1:
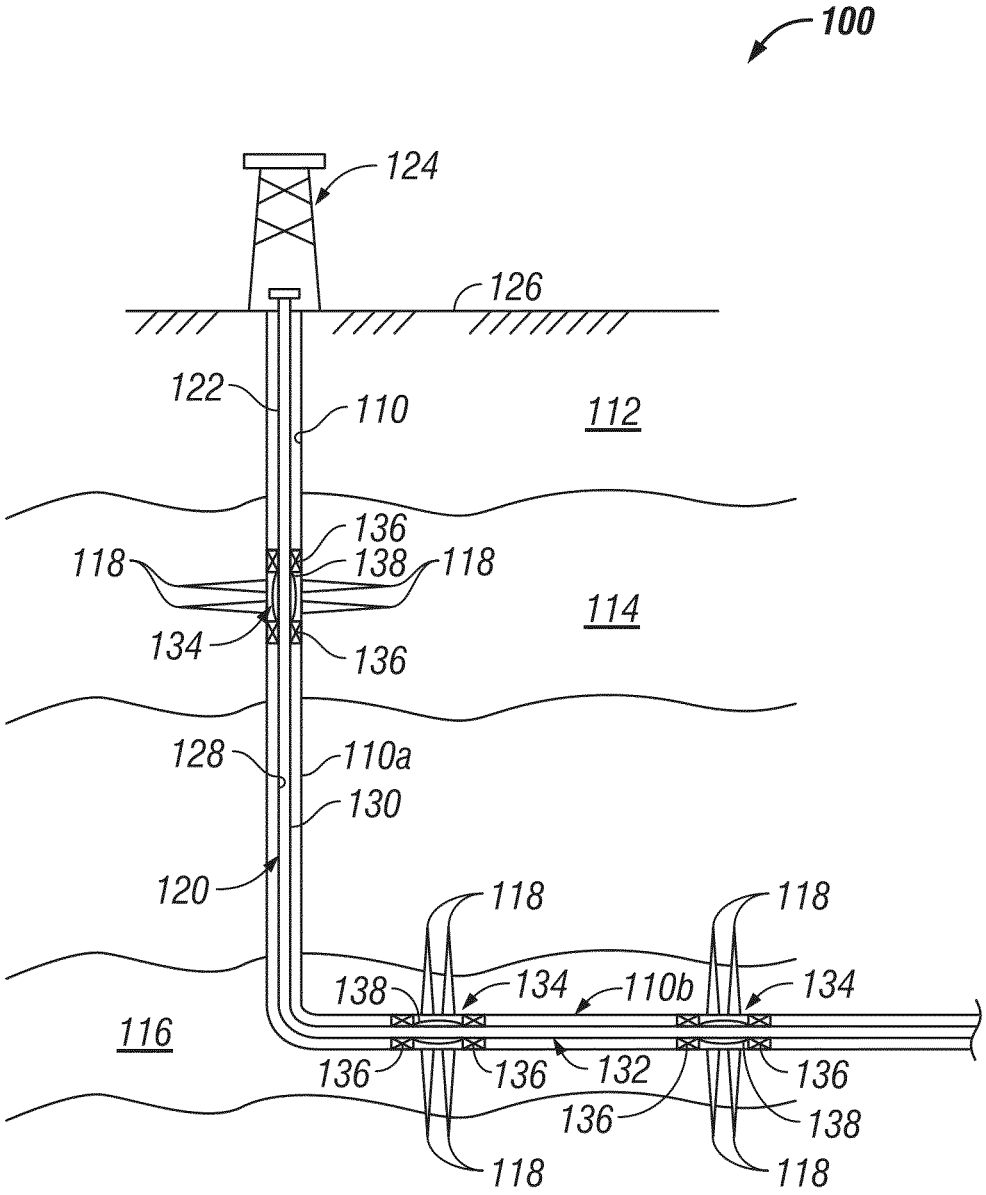
FIG. 1 is a schematic elevation view of an exemplary multi-zone wellbore that has a production string installed therein, which production string includes a number of ICDs placed at selected locations along the length of the production string.

Referring initially to FIG. 1, there is shown an exemplary fluid production system 100 that includes a wellbore 110 drilled through an earth 112 and into a pair of production zones or reservoirs 114, 116 from which the production of hydrocarbons is intended. The wellbore 110 is shown lined with a casing having a number of perforations 118 that penetrate and extend into the formations production zones 114, 116 so that production fluids may flow from the production zones 114, 116 into the wellbore 110. The exemplary wellbore 110 is shown to include a vertical section 110*a* and a substantially horizontal section 110*b*. The wellbore 110 includes a production string (or production assembly) 120 that includes a tubing (also referred to as the base pipe) 122 that extends downwardly from a wellhead 124 at the surface 126 of the wellbore 110. The production string 120 defines an internal axial bore 128 along its length. An annulus 130 is defined between the production string 120 and the wellbore casing. The production string 120 has a deviated, generally horizontal portion 132 that extends along the deviated leg 110*b* of the wellbore 110. Production devices 134 are positioned at selected locations along the production string 120. Optionally, each production device 134 is isolated within the wellbore 110 by a pair of packer devices 136. Although only two production devices 134 are shown along the horizontal portion 132, there may, in fact, be a large number of such production devices arranged along the horizontal portion 132.

Each production device 134 features a production control device (or flow control device) 138 used to govern one or more aspects of flow of one or more fluids from the production zones into the production string 120. As used herein, the term "fluid" or "fluids" includes liquids, gases, hydrocarbons, multi-phase fluids, mixtures of two of more fluids, water and fluids injected from the surface, such as water. Additionally, references to water should be construed to also include water-based fluids; e.g., brine or salt water. In accordance with embodiments of the present disclosure, the flow control device 138 may have a number of alternative structural features that provide selective operation and controlled fluid flow therethrough.

Subsurface formations typically contain water or brine along with oil and gas. Water may be present below an oil-bearing zone and gas may be present above such a zone. A horizontal wellbore, such as section 110*b*, is typically drilled through a production zone, such as production zone 116, and may extend to more than 5,000 feet in length. Once the wellbore has been in production for a period of time, water flow into some of the flow control devices 138. The amount and timing of water inflow can vary along the length of the production zone. It is desirable to have flow control devices that will restrict the flow of fluids when a selected amount of water is present in the production fluid. In an aspect, by restricting the flow of production fluid containing water, the flow control device enables more oil to be produced over the production life of the production zone.

Figure 2:
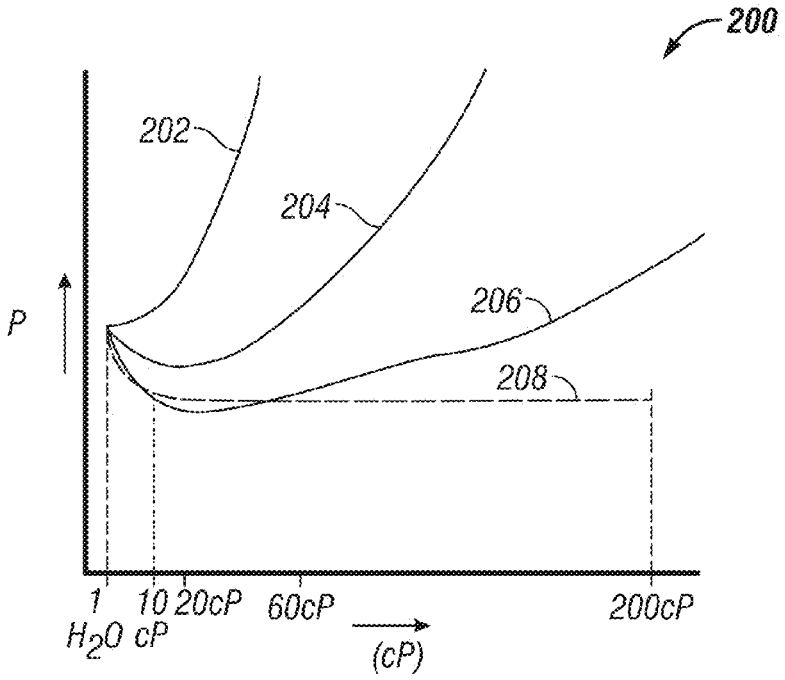
FIG. 2 is a graph showing pressure drop as a function of fluid viscosity for certain types of available flow control device and also a desired pressure drop for a flow control device for controlling flow of water therethrough.

FIG. 2 shows a graph 200 illustrating the pressure drop behavior of certain types of ICDs for fluids of different viscosities. The pressure drop "$\Delta p$" across the device is shown along the vertical axis and the fluid viscosity "$\mu$" is shown along the horizontal axis. The viscosity of pure water is 1 cP and the viscosity of the majority of oils present in subsurface formations is between 10 cP-200 cP. Curve 202 depicts the pressure drop for an orifice-type ICD, in which most of the pressure drop occurs at the orifice and it is a function of the diameter of the orifice. The total pressure drop across the orifice-type ICD is generally the sum of the pressure drops across all the orifices contained in the ICD. It can be seen that the pressure drop increases sharply as the fluid viscosity increases. In particular, the pressure drop for most oils is greater than the pressure drop for water. Curve 204 corresponds to a helical type ICD, in which the production fluid flows along a relatively long helical path around a tubular member. Curve 204 shows that the pressure drop for water is greater than the pressure drop for fluids with viscosity up to about 60 cP. The pressure drops for water and for fluids with viscosity up to about 20 cP and it starts to rise for fluids with viscosity greater than about 20 cP. Curve 204 indicates some blockage of water and also that of oils above 20 cP viscosity. Curve 206 corresponds to a hybrid design that includes orifices separated by a tortuous flow path. One such ICD is described in U.S. patent application Ser. No. 12/417,346, filed on Apr. 2, 2009, assigned to the assignee of this application, which is incorporated herein by reference in its entirety. Curve 206 shows that the change in the pressure drop across such devices is higher than the change in pressure drop across helix-type devices and further that the pressure drop continues to decrease for fluids with viscosity up to about 60 cp. This shows that the such devices provide water blockage and that less obstruction certain types of oils compared to the helix-type devices. Devices that correspond to the curve 206 tend to better inhibit the flow of water into the wellbore compared to the orifice and helical devices. The data shown for curves 202, 204 and 206 is obtained from laboratory test results.

Still referring to FIG. 2, It is desirable to provide flow control devices that will increase pressure drop for low viscosity fluids, such as fluids having viscosity below about 6 cP or 10 cP, and substantially constant pressure drop for fluids having viscosity in a range above 6 cP or 10 cP. The pressure drop may increase exponentially as the viscosity decreases in such ranges. Curve 208 shows a more desired pressure drop behavior for a fluid flow through the flow control device, wherein the pressure drop is substantially greater for fluids with viscosities in a first range, such as viscosities below about 10 cP, and substantially constant for fluids with viscosities in a second range, such as above about 6 cP or 10 cP.

Figure 3:
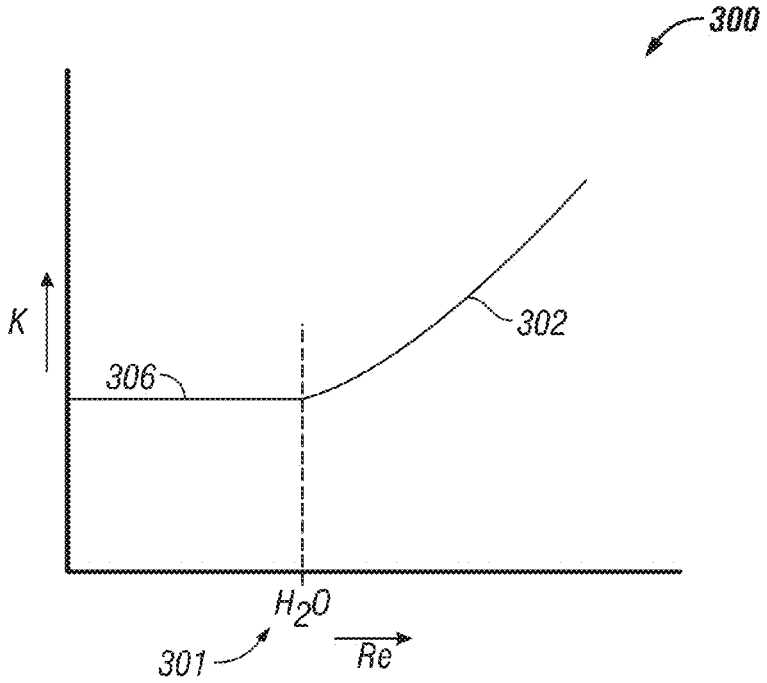
FIG. 3 is a graph showing a desired relationship between Reynolds number and a pressure loss coefficient for a flow control device for controlling flow of water therethrough.

FIG. 3 shows a graph 300 of a desired performance curve for a flow control device expressed as a relationship between Reynolds number "Re" and pressure loss coefficient "K." The Re is shown along the vertical axis and K along the horizontal axis. Reynolds number Re is dimensionless and is a ratio between inertia forces and viscous forces. Re for fluids may be expressed as:

$$\text{Re}=\text{Inertia forces/viscous force}$$

$$\text{Re}=(\rho\cdot V\cdot dv/dx)/\mu\cdot d^2v/dx^2$$

$$\text{Re}=\rho VD/\mu, \text{ wherein}$$

ρ is density of the fluid, V is flow volume, v is the fluid velocity, D is a dimension of the flow area, such as diameter of an opening, and μ is the viscosity of the fluid. The Reynolds number for low viscosity fluids, such as water is relatively high compared to the high viscosity fluids, such as oils. Therefore, Re may also be expressed as:

$$\text{Re}=f(\text{density, viscosity, fluid velocity and surface dimension(s)})$$

Pressure drop Dp across a flow area A may be expressed as:

$$Dp=K\cdot(\rho/A^2)\cdot v^2,$$

where A is the flow area. The pressure loss coefficient K is a function of Reynolds number Re (K=f (Re)). The inventors have determined that K also is a function of the geometry of the flow path of the fluid through the flow control device and in particular the tortuosity of the flow path within the flow control device, and that therefore inducing turbulence in the flow of a fluid affects the pressure drop of fluids of different viscosities, as described in more detail later. The pressure loss coefficient K may be expressed as:

$$K=f(\text{Re, opening size, tortuosity}).$$

Graph 300 shows demonstrates that it is desirable to have a flow control device that exhibits a high value of pressure loss coefficient K for fluids with a Reynolds number higher than the Reynolds number for water 301, as shown by the curve segment 302. Graph 300 also shows that it desirable to have a relatively constant pressure loss coefficient K for Reynolds numbers less than the Reynolds number for water 301, as shown by the curve segment 306. The overall behavior of a fluid through an ICD depends upon the rheology of the fluid. Rheology is a function of several parameters, including, but not limited to, flow area, tortuosity, friction, fluid velocity, fluid viscosity and fluid density. In aspects, rheology parameters may be calculated or assumed to provide flow control devices that will inhibit water flow. The disclosure herein utilizes fluid rheology principles and other factors noted above to provide flow control devices that inhibit flow of fluids with viscosity or density in one range and allow a substantially constant flow of fluids with viscosity or density in another range. Exemplary flow control devices and methods of making such devices are described in reference to FIGS. 4-14.

Figure 4:
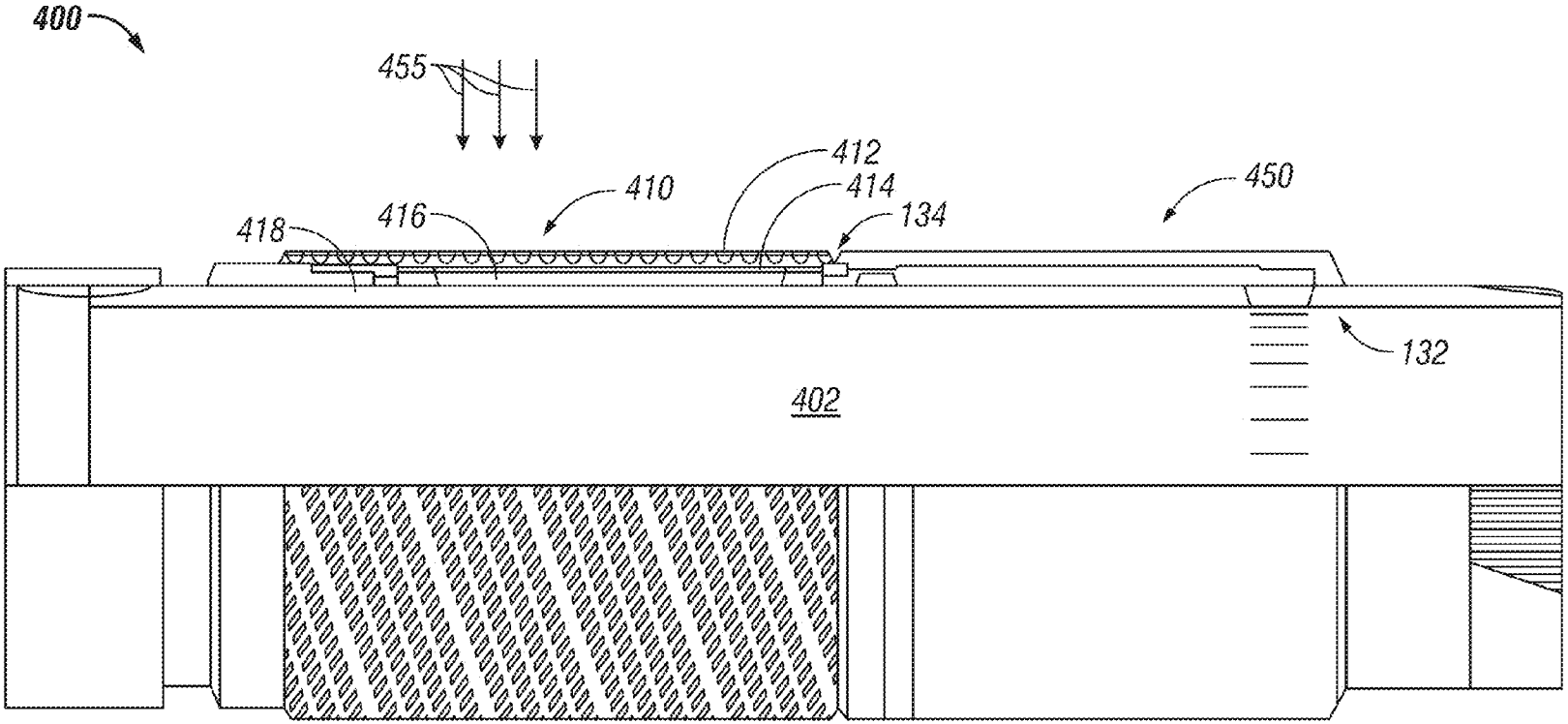
FIG. 4 is an isometric view of a flow control device including a particulate filtration device and a passive flow control device in accordance with one embodiment of the disclosure.

Referring now to FIG. 4, there is shown one embodiment of a production device 400 for controlling the flow of fluids from a reservoir into a production string. The device 400 is shown to include a particulate control device or filtration device 410 for reducing the amount and size of particulates entrained in the fluids and an ICD 450 that controls the overall drainage rate of the formation fluid 455 into the wellbore. In one embodiment the filtration device 410 may include a shroud 412 placed around a tubing 402, a filtration media 414 placed between the shroud 412 and the tubing 402, and a flow path 416 placed between the filtration media 414 and a tubular 418. Formation fluid flows into the shroud 412, which has a pattern of perforations that allow the formation fluid to flow into the filtration device 410. Shroud 412 insulates the components of the filtration device 410 from direct exposure to the formation fluid containing solid particles and relatively high velocity fluids. In addition, the shroud 412 inhibits the flow of large solid particles from entering the filter media 414. Filter media 414 filters relatively small solid particles and allows the formation fluid to flow into the fluid flow path 416, and then into the flow control device 450. Exemplary flow control devices are described herein below.

Figure 5:
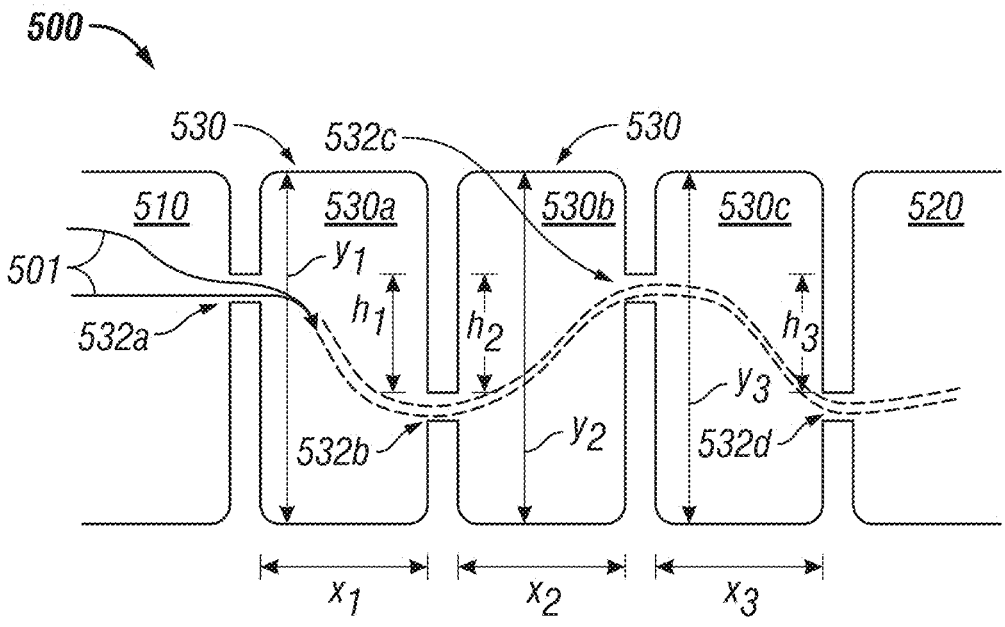
FIG. 5 shows an exemplary structural flow pattern or flow channel for a flow control device made according to one embodiment of the disclosure.

FIG. 5 shows an exemplary structural flow pattern for a flow control device 500 made according to one embodiment of the disclosure. The flow control device 500, in one aspect, may include an inflow region 510 and outflow region 520 and a flow-through region 530. The flow-through region 530 may further include one or more stages, such as stages 530*a*, 530*b*, 530*c*, etc. In the flow configuration of flow control device 500, formation fluid 501 enters the inflow region 510, which fluid then enters the first stage 530*a* via a port or an opening 532*a* and discharges from a port 532*b* into the second stage 530*b*. The fluid from the second stage 530*b* discharges into the next stage 530*c* via port 532*c* and then into the outflow region 520 via port 532*d*.

In aspects, the first stage 530*a* may have a width or axial flow distance x1 and a height or radial distance y1. The offset or misalignment between the inlet port 532*a* and the outlet port 532*b* for stage 530*a* is denoted by h1. Similarly, the axial flow distance, radial distance, and outlet ports for subsequent stages 530*b* and 530*c* are respectively denoted by x2, h2 and d3, and x3, h3 and d4. The fluid path through such stages is denoted by Fp1, Fp2 and Fp3. The first substantial pressure drop Dp1 occurs at the port 532*a*. The fluid 501 then flows along a tortuous path Fpi and exits through port 532*b*. The second pressure drop Δp2 occurs at port 532*b*. Similarly, subsequent pressure drops occur at ports 532*c* and 532*d*. In an embodiment, the majority of the pressure drops occur at the ports. The pressure drop across the device 500 is approximately the sum of the pressure drops at each stage, namely Δp1, Δp2 and Δp3. As noted earlier, for a given fluid type (viscosity, density, etc.) and a flow rate, the pressure drop depends upon the flow areas, tortuosity of flow path, etc. In one aspect, each stage in the flow control device 500 may have same physical dimensions. In another aspect, the radial distance, port offset and port size may be chosen to provide a desired tortuosity so that the pressure drop will be a function of the fluid viscosity or density. In other aspect, the dimension of such stages may be different. It has been determined that an flow control device made according to the aspects shown in FIG. 5 may provide higher pressure drop for fluids having relatively low viscosity, for example less than 10 cP, and a substantially constant pressure drop for fluids having viscosity in a range above 10 cP. In general, the pressure drop across a port, such as port 532*b* is a function of offset (h), axial distance (x) and a port dimension (d). In one aspect, the relationship may be x/h>d/h. In another aspect, dimension h may be 4-6 times d.

Figure 6:
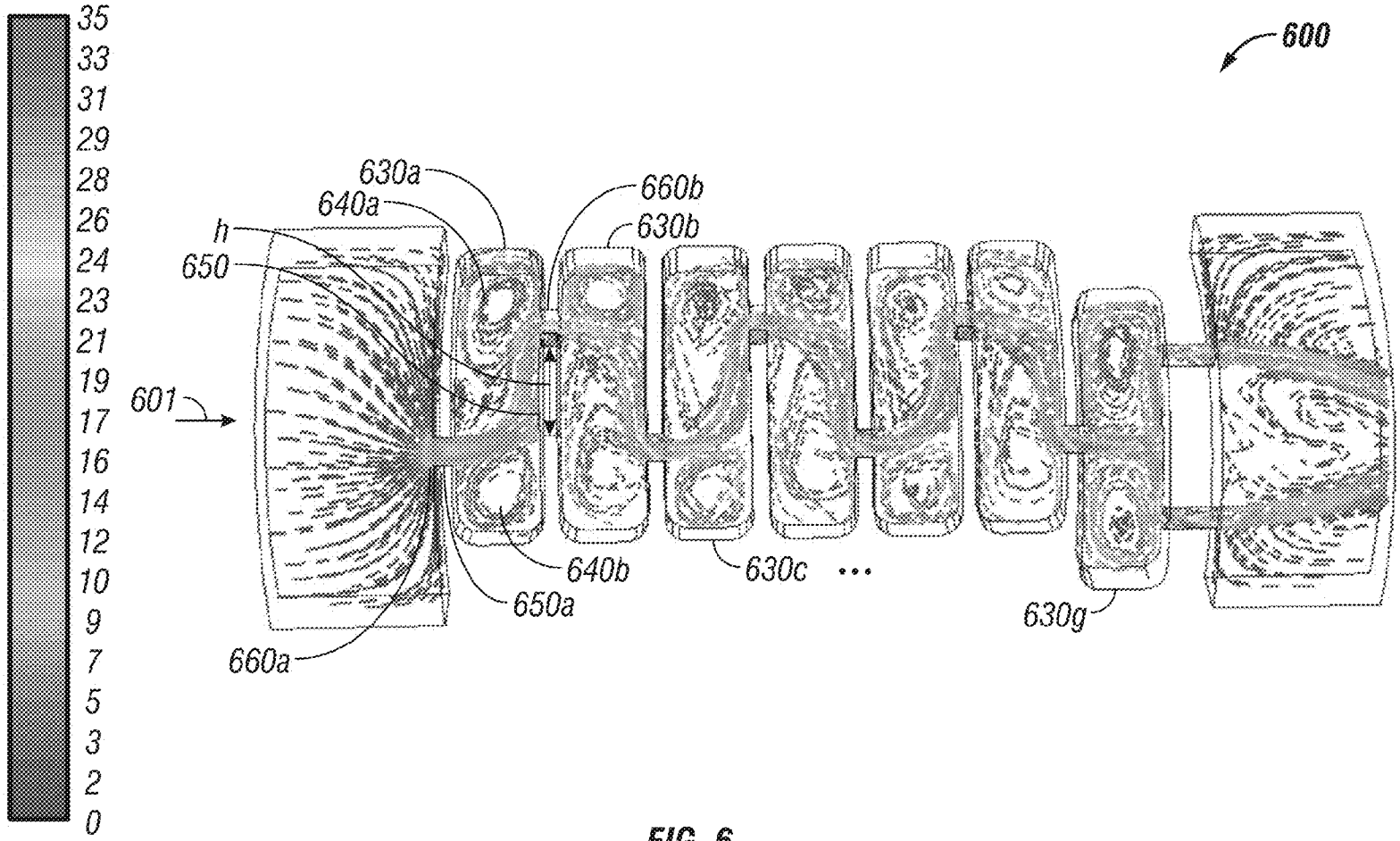
FIG. 6 is a flow diagram showing simulation results of flow velocity of water for a multi-stage flow channel, such as shown in FIG. 5.

FIG. 6 is a flow diagram 600 showing simulation results of flow velocity of water for a multi-stage (630*a*-630*g*) flow control device such as shown in FIG. 5, wherein path lines are colored by velocity magnitude (ft/sec). The velocity of fluid increases as the fluid 601 progresses from one stage to the next. Loops, such as loop 640*a* and 640*b* in stage 632*a*, indicate that fluid has a relatively low velocity and may thus be considered substantially non-flowing through the stage 630*a*. The fluid 601 flows along a tortuous flow path 650*a* in the first stage 632*a*, which flow path includes an axial path 650*a* and a radial path 650*b*. The offset or misalignment between the ports is "h." The fluid 601 then exits the port 660*b*. The tortuosity of the fluid path 650 and the corresponding pressure drop at port 660*b* may be controlled by the combination of axial distance, radial distance, offset and port size. Accordingly, in an embodiment, a flow control device may be designed to restrict the flow of a fluid containing water by selecting the corresponding axial distance, radial distance, offset and port size to cause a significant pressure drop across the flow control device.

Figure 7:
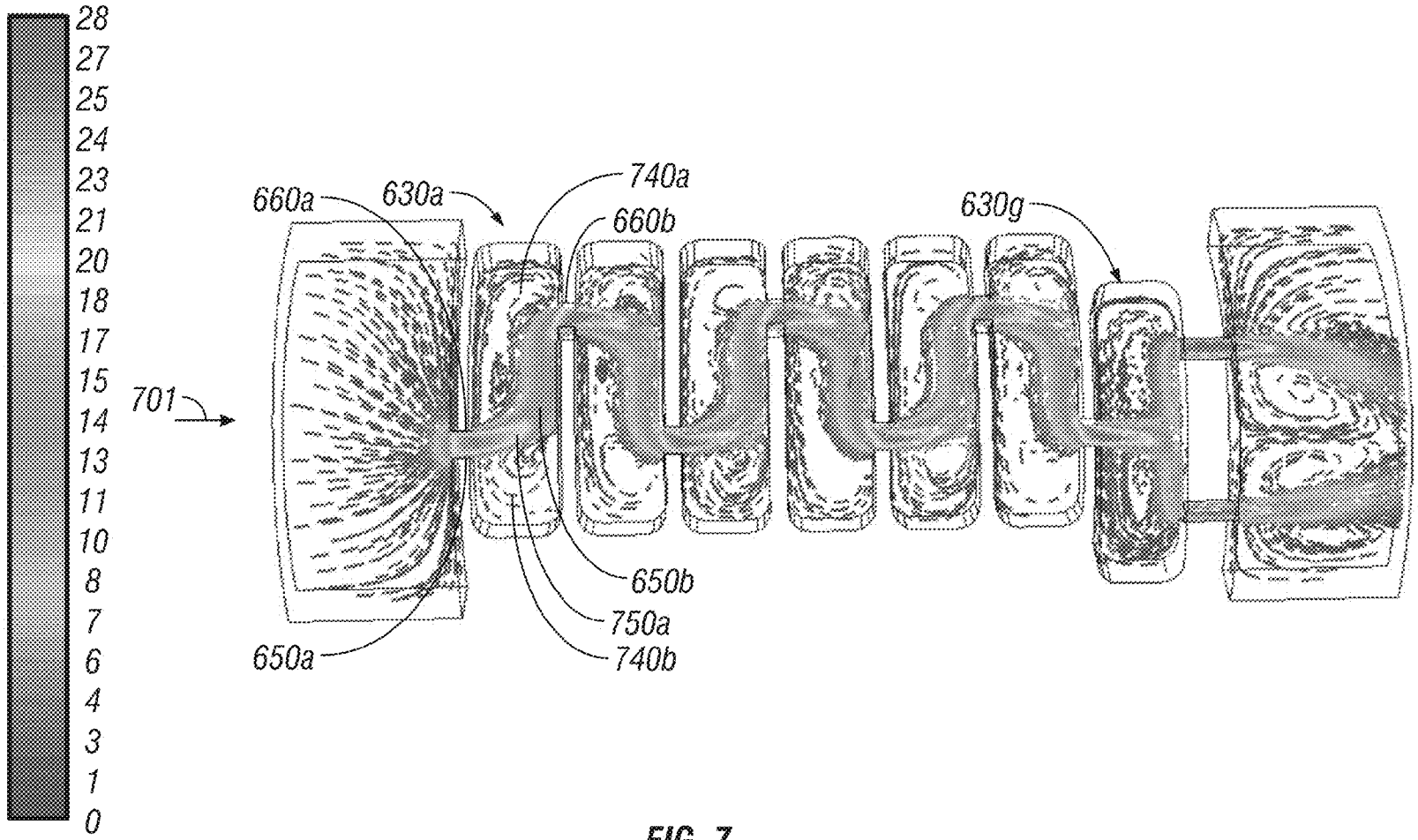
FIG. 7 is a flow diagram showing simulation results of flow velocity of an oil having viscosity of 189 cP for the multi-stage channel shown in FIG. 5.

FIG. 7 is a flow diagram 700 showing simulation results of flow velocity of an oil having viscosity of 189 cP for the multi-stage (630*a*-630*g*) flow control device shown in FIG. 6, wherein path lines are colored by velocity magnitude (ft/sec). The velocity of fluid increases as the fluid 701 progresses from one stage to the next. Loops, such as loop 740*a* and 740*b* in stage 630*a*, indicate that fluid has a relatively low velocity and may thus be considered substantially non-flowing through the stage 630*a*. It should be noted that these velocity loops are less intense when compared to loops 640*a* and 640*b* for water. The fluid 701 flows along a tortuous flow path 750*a* in the first stage 630*a*, which flow path includes a first substantially axial path 650*a* and a second substantially radial path 650*b*. The radial path 650*b* substantially equal to the offset distance "h." The fluid 701 then exits the port 660*b*. The tortuosity of the fluid path 650 and the corresponding pressure drop at port 660*b* may be controlled by choosing the combination of axial distance, offset and the port size. Higher turbulence tends to create higher pressure drop across the ports of devices, such as shown in FIG. 7.

Figure 8:
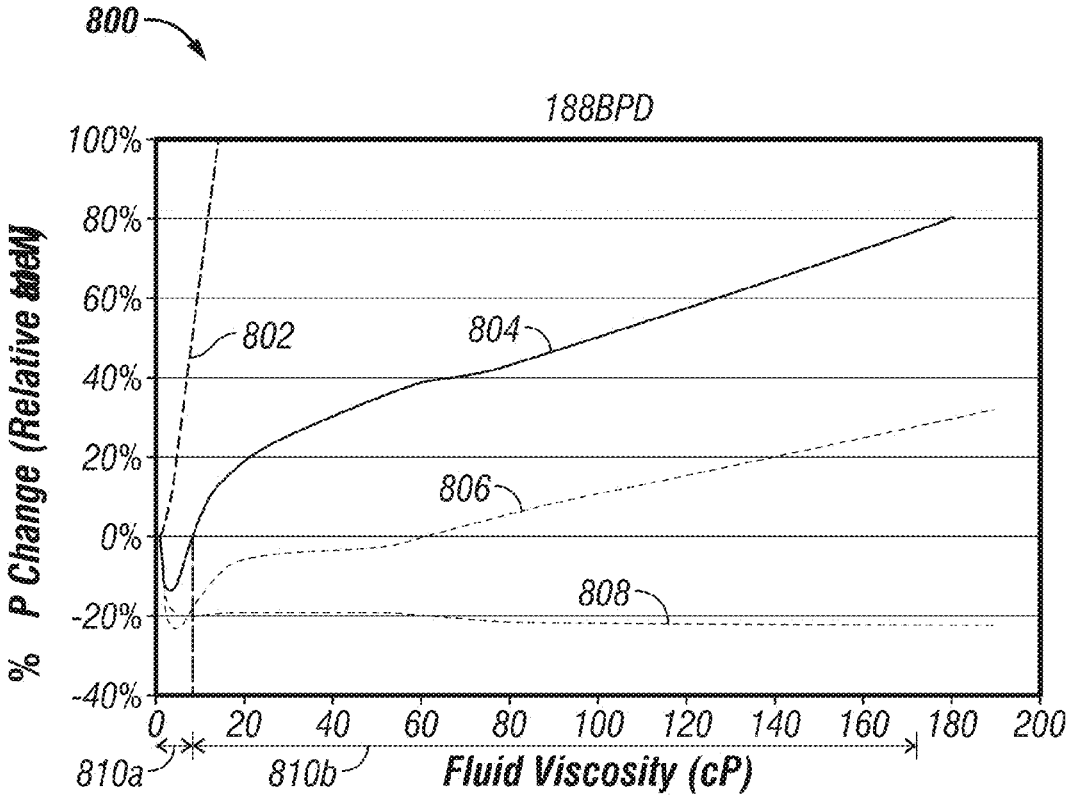
FIG. 8 shows laboratory test results of pressure drop versus viscosity for an exemplary orifice device, a helical device, a hybrid device and also a desired pressure drop for a flow control device for controlling flow of water therethrough.

FIG. 8 shows an exemplary comparison chart 800 of pressure drops relative to water for an orifice-type device, helical device, a hybrid device and a device, such as shown in FIGS. 6 and 7. The percent pressure drop change relative to water is depicted along the vertical axis and the viscosity of the fluid along the horizontal axis. Curve 802 corresponds to an orifice type flow control device, curve 804 corresponds to a helical device, curve 806 corresponds to a hybrid device and curve 808 corresponds to a flow control device of the type shown in FIGS. 6 and 7. It is noted that a flow control device made according to the principles described in reference to FIGS. 6 and 7 exhibits relatively high percentage pressure drop change for low viscosity fluid, such as fluids in the viscosity range shown by 810*a* (up to about 10 cP) and a substantially constant pressure drop for fluids in the viscosity range 810*b* (from about 10 cP to 180 cP).

Figure 9:
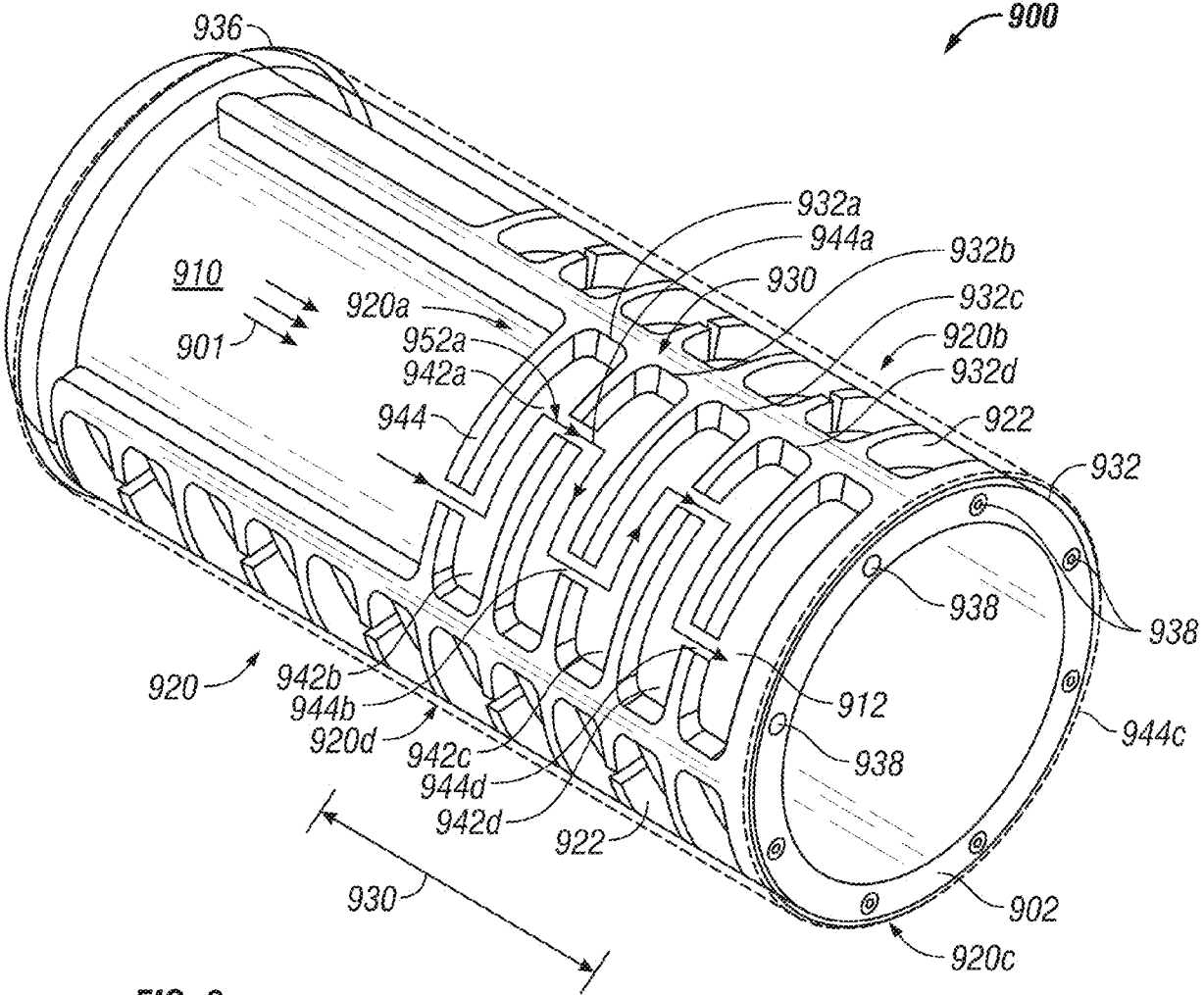
FIG. 9 shows an isometric view of a flow control device made according to one embodiment the disclosure.

FIG. 9 shows an isometric view of an embodiment of a passive flow control device 900 made according the principles described herein. The flow control device 900 is shown to include a number of structural flow sections 920*a*, 920*b*, 920*c* and 920*d* formed around a tubular member 902, each such section defining a flow channel or flow path. Each section may be configured to create a predetermined pressure drop to control a flow rate of the production fluid from the formation into the wellbore tubing. One or more of these flow paths or sections may be occluded (not in hydraulic communication with another section) in order to provide a selected or specified pressure drop across such sections. Fluid flow through a particular section may be controlled by closing ports 938 provided for the selected flow section. The total pressure drop across the device 900 is the sum of the pressure drops created by each active section. Structural flow sections 920*a*-920*d* may also be referred to as flow channels. To simplify description of the device 900, the flow control through each channel is described in reference to channel 920*a*. Channel 920*a* is shown to include an inflow region 910 and an outflow region or area 912. Formation fluid enters the channel 920*a* into the inflow region 910 and exits the channel via outflow region 912. Channel 920*a* creates a pressure drop by channeling the flowing fluid through a flow-through region 930, which may include one or more flow stages or conduits, such as stages 932*a*, 932*b*, 932*c* and 932*d*. Each section may include any desired number of stages. Also, in aspects, each channel in a device may include a different number of stages. In another aspect, each channel or stage may be configured to provide an independent flow path between the between the inflow region and the outflow region. As noted earlier, some or all of channels 920*a*-920*d* may be substantially hydraulically isolated from one another. That is, the flow across the channels and through the device 900 may be considered in parallel rather than in series. Thus, the flow across one channel may be partially or totally blocked without substantially affecting the flow across another channel. It should be understood that the term "parallel" is used in the functional sense rather than to suggest a particular structure or physical configuration.

Still referring to FIG. 9, there are shown further details of the flow control device 900 which creates a pressure drop by conveying the in-flowing fluid through one or more of the plurality of channels 920*a*-920*d*. Each of the channels 920*a*-920*d* may be formed along a wall of a base tubular or mandrel 902 and include structural features configured to control flow in a predetermined manner. While not required, the channels 920*a*-920*d* may be aligned in a parallel fashion and longitudinally along the long axis of the mandrel 902. Each channel may have one end 132 in fluid communication with the wellbore tubular flow bore 402 (FIG. 4) and a second end 134 (FIG. 3) in fluid communication with the annular space or annulus separating the flow control device 120 and the formation. Generally, channels 920*a*-920*d* may be separated from one another, for example in the region between their respective inflow and outflow regions.

In embodiments, the channel 920*a* may be arranged as a maze or labyrinth structure that forms a tortuous or circuitous flow path for the fluid flowing therethrough. In one embodiment, each stage 932*a*-932*d* of channel 922*a* may respectively include a chamber 942*a*-942*d*. Openings 944*a*-944*d* hydraulically connect chambers 942*a*-942*d* in a serial fashion. In the exemplary configuration of channel 920*a*, formation fluid enters into the inflow region 910 and discharges into the first chamber 942*a* via port or opening 944*a*. The fluid then travels along a tortuous path 952*a* and discharges into the second chamber 942*b* via port 944*b* and so on. Each of the ports 944*a*-944*d* exhibit a certain pressure drop across the port that is function of the configuration of the chambers on each side of the port, the offset between the ports associated therewith and the size of each port. The stage configuration and structure within determines the tortuosity and friction of the fluid flow in each particular chamber, as described herein. Different stages in a particular channel may be configured to provide different pressure drops. The chambers may be configured in any desired configuration based on the principles, methods and other embodiments described herein.

Figure 10:
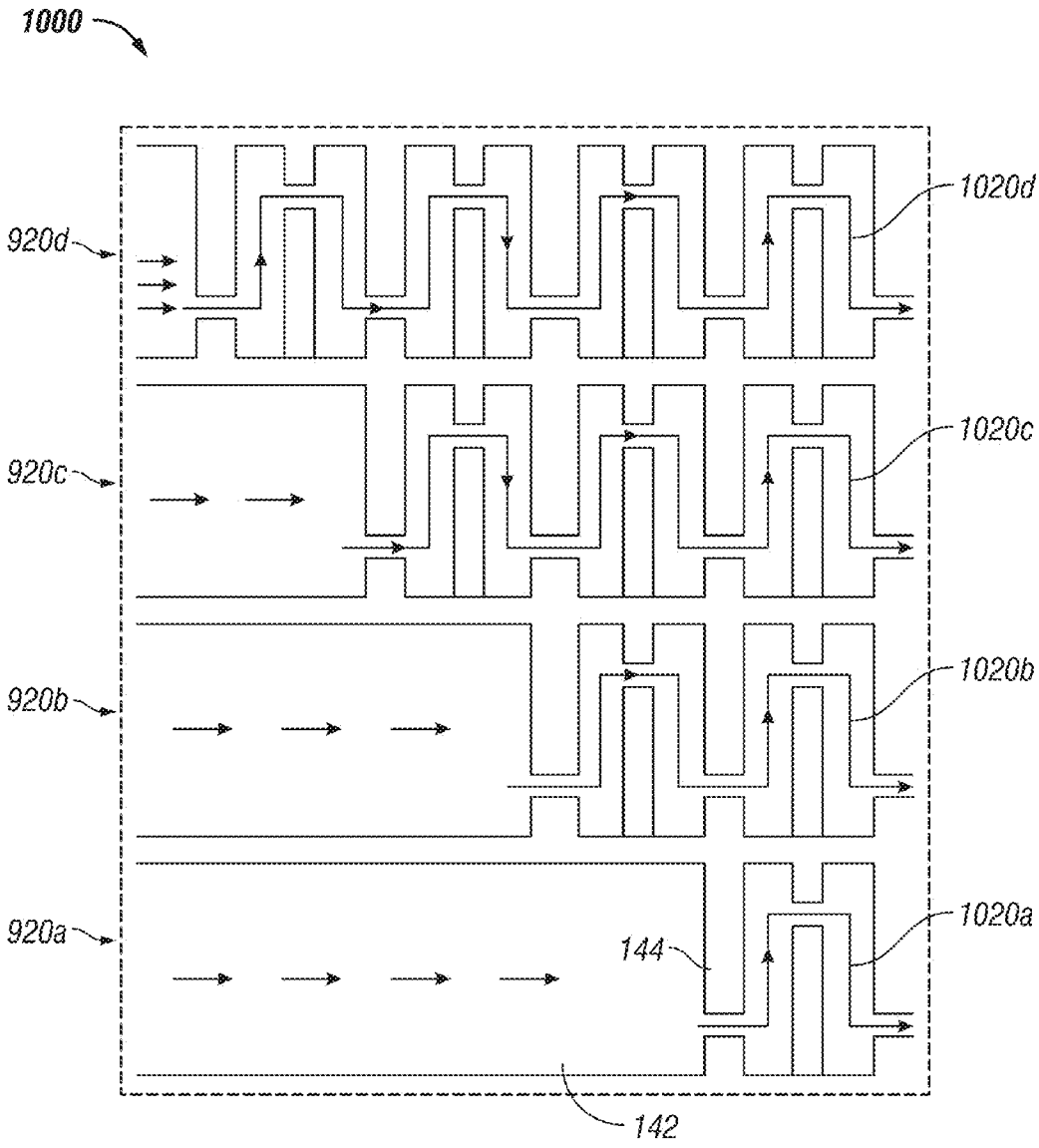
FIG. 10 shows the fluid flow paths for illustrative channels of the flow control device shown in FIG. 9.

FIG. 10 shows the fluid flow paths for the four illustrative channels 920*a*-920*d* of the flow control device 900. For ease of explanation, the flow control device 900 is shown in phantom lines and "unwrapped" in order to better depict the channels 920*a*-*d* in a flat plane, as opposed to the tubular depiction of FIG. 9. Each of these channels 920*a*-9202*d* provides a separate and independent flow path between the annulus or formation and the tubular bore 402 (FIG. 4), as shown by flow paths 1020*a*-1020*d*. Also, in the embodiment shown, each of the channels 920*a*-920*d* provides a different pressure drop for a flowing fluid. The channel 920*a* is constructed to provide the least amount of resistance to fluid flow and thus provides a relatively small pressure drop. The conduit 920*d* is constructed to provide the greatest resistance to fluid flow and thus provides a relatively large pressure drop. The conduits 920*b* and 920*c* provide pressure drops in a range between those provided by the conduits 920*a* and 920*d*. It should be understood, however, that in other embodiments, two or more of the conduits may provide the same pressure drops or that all of the conduits may provide the same pressure drop. As noted earlier, fluid flow from any of the channels may be either partially or completely blocked. Thus, the fluid flow across the flow control device 900 may be adjusted by selectively occluding one or more of the channels 920*a*-920*d*. The number of permutations for available pressure drops, of course, varies with the number of channels, which may be one or more as desired. Thus, in embodiments, the flow control device 900 may provide a pressure drop associated with the flow across one channel, or a composite pressure drop associated with the flow across two or more channels. Such a device may be configured at the field and differently configured devices may be placed along the wellbore.

Additionally, in embodiments, some or all of the surfaces of the channels 920*a*-920*d* may be constructed to have a specific frictional resistance to flow. In some embodiments, the friction may be increased using textures, roughened surfaces, or other such surface features. Alternatively, friction may be reduced by using polished or smoothed surfaces. In embodiments, the surfaces may be coated with a material that increases or decreases surface friction. Moreover, the coating may be configured to vary the friction based on the nature of the flowing material (e.g., water or oil). For example, the surface may be coated with a hydrophilic material that absorbs water to increase frictional resistance to water flow or a hydrophobic material that repels water to decrease frictional resistance to water flow.

Figure 11:
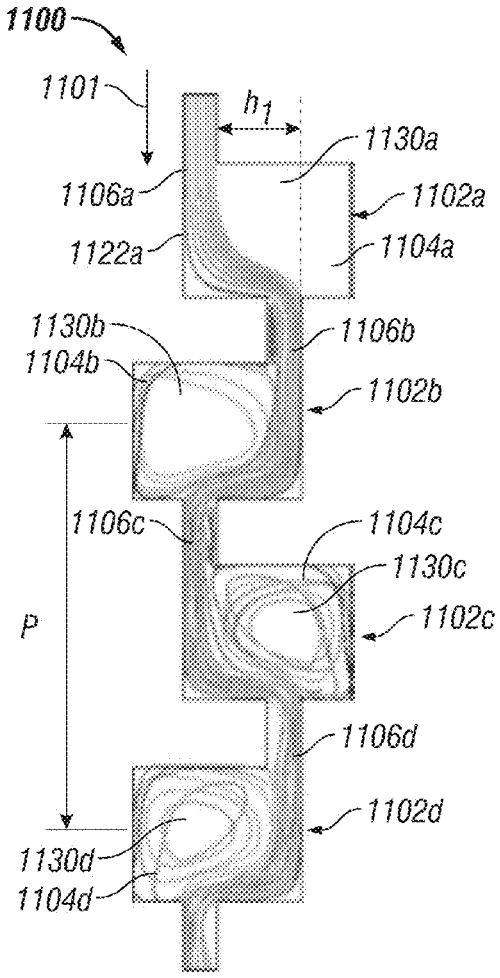
FIG. 11 shows a flow channel that may be utilized in a flow control device made according to an embodiment of the disclosure.

FIG. 11 shows an exemplary channel or flow channel 1100 that may be utilized in an inflow control device made according to one embodiment of the disclosure. Such a flow control device may include one or more such flow channels or a combination of channels. For illustration purposes, channel 1100 is shown to include stages 1102*a*-1102*d*, each of which respectively includes a chamber or flow area 1104*a*-1104*d* and a corresponding outflow port or conduit 1106*a*-1106*d*. The fluid flow regime shown in FIG. 11 is a result of simulation for water flowing through the channel 1100. Formation fluid 1101 enters the first chamber 1104*a* via a conduit 1106*a* and discharges into chamber 1104*b* via conduit 1106*b*. The fluid path 1120*a* in the first chamber 1102*a* is defined by the straight section 1122*a* of chamber 1102*a* and the offset h1 between conduits 1106*a* and 1106*b*. The pressure drop occurs at opening of conduit 1106*b*. The flow path in subsequent chambers is defined by similar physical parameters. The physical configuration of the stages may be designed to provide a substantially high pressure drop for fluid with viscosities or densities in a first range (such as fluids containing water) and a substantially constant pressure drop in a second range (such as fluids containing mostly oil). Simulation results show that for water for a given mass flow (volume), the pressure drop $\Delta p$ across stages 1102*a*-1102*c* is approximately 4.88 times the pressure drop relative to water flowing in a straight pipe section. The amount of the pressure drop may vary by the choice of chamber and conduit parameters. Areas 1130*a*-1130*d* respectively show zones that do not significantly affect the pressure drop across their respective stages. In addition, the structure and configuration of the chambers defines the tortuosity and turbulence induced in the flowing fluid, defines the reduction in the effective opening of each port between chambers. For example, a chamber that causes a significant amount of turbulence may cause only about 70% of a port's opening to allow fluid flow, due to substantial resistance in and around the port. This behavior may also be selectively controlled to produce a desired pressure drop across each stage.

Figure 12:
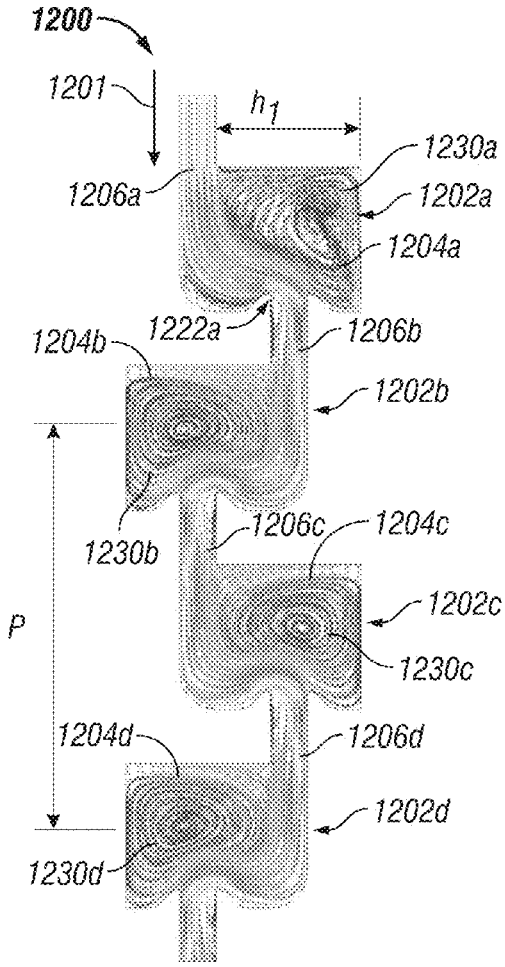
FIG. 12 shows another flow channel that may be utilized in a flow control device made according to another embodiment of the disclosure.

FIG. 12 shows a flow channel 1200 that may be utilized in an inflow control device made according to another embodiment of the disclosure. For illustration purposes, channel 1200 is shown to include stages 1202*a*-1202*d*, each of which respectively includes a chamber 1204*a*-1204*d* coupled by a corresponding conduit 1206*a*-1206*d*. The fluid flow regimes shown in FIG. 12 are simulation results for water flowing through the channel 1200. Formation fluid 1201 enters the first chamber 1204*a* via a conduit 1206*a* and discharges into chamber 1204*b* via conduit 1206*b*. The fluid path 1220*a* in the first chamber 1204*a* is defined by the curved section 1222*a* of chamber 1204*a* and the offset h1 between conduits 1206*a* and 1206*b*. The pressure drop occurs at outflow port of each conduit. The flow path in each of the subsequent stages 1202*b*-120*d* is defined by similar physical parameters. The physical or structural configuration of each stage may be designed so as to provide a substantially high pressure drop for fluids with viscosities or densities in a first range (such as fluids containing water) and a substantially constant pressure drop for fluids with viscosities or densities in a second range (such as fluids containing mostly oil). Simulation results show that for given volume of water flow, the pressure drop $\Delta p$ across stages 1202*b*-1202*c* is approximately 5.60 times the pressure drop for same volume of water flowing in a straight pipe section. The amount of the pressure drop may varied by the choice of parameters of each stage. Areas 1230*a*-1230*d* correspond to zones that do not significantly contribute to the pressure drops.

Figure 13:
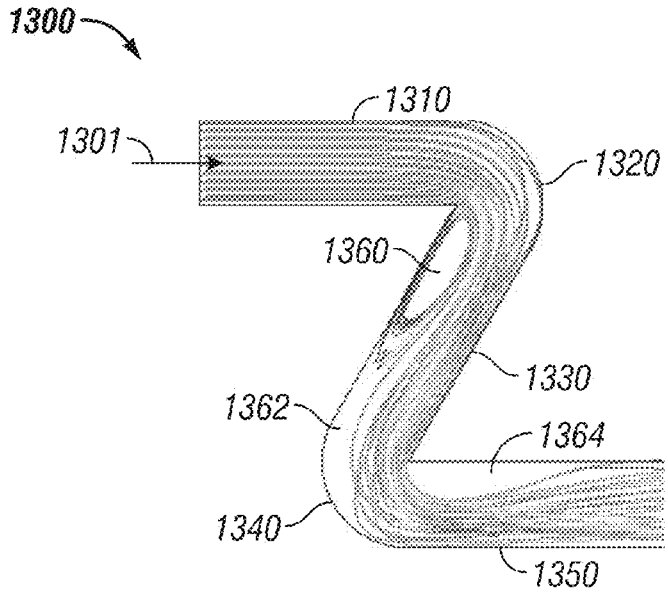
FIG. 13 shows yet another flow channel that may be utilized in an inflow control device made according to yet another embodiment of the disclosure.

FIG. 13 shows another flow channel 1300, which may be utilized in yet another embodiment of a flow control device made according to the disclosure. The channel 1300 is shown to be a Z-shaped channel, which includes a first substantially straight section 1310, a first angled or bent section 1320, a second substantially straight section 1330, a second angled or bent section 1340 and a third substantially straight section 1350. Flow paths shown in FIG. 13 are the results of simulation for water flow 1301 through the section 1300. In the flow channel 1300, turbulences induced in the flow reduce the effective flow area proximate each bend. For example, area 1360 shows relatively negligible fluid flow or a dead area, which reduces the available flow area along the bend 1320. Similarly, a relatively dead or no-flow area 1362 reduces the effective flow area proximate bend 1340 and area 1364 reduces the flow area in section 1350 proximate the bend 1340. Simulation results show that the pressure drop for water in a particular embodiment is about 4.11 relative to the pressure drop for water in a pipe section.

Figure 14:
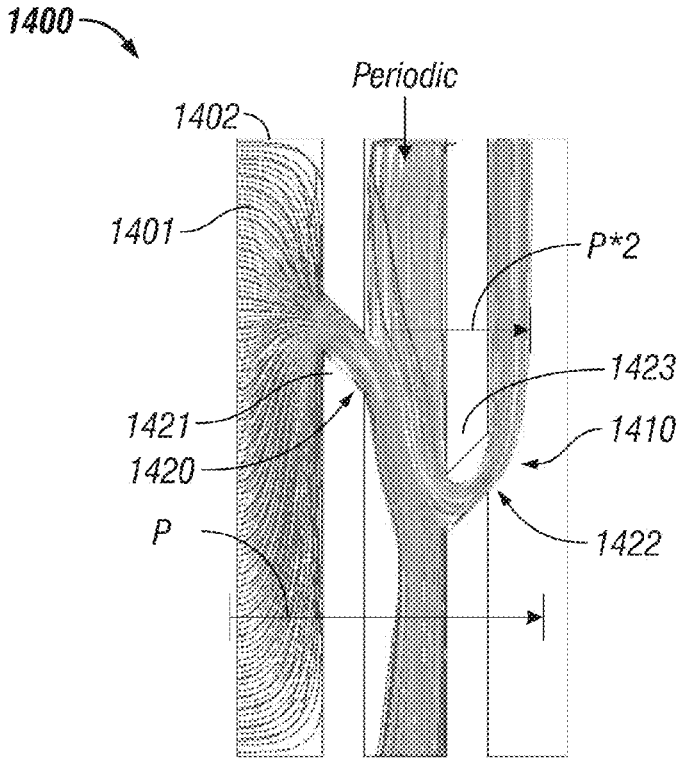
FIG. 14 shows yet another flow channel that may be utilized in an inflow control device made according to yet another embodiment of the disclosure.

FIG. 14 shows flow channel 1400, in which formation fluid 1401 flows form an inflow region 1402 into a contoured or tortuous path 1410 that includes a first bend 1420. In one aspect, the loop around adds inertia tangential to the bends, which may increase pressure drop across the second bend 1422. The fluid then loops around a member 1430 and exits via a second bend 1422. The angles 1421 and 1423 of the bends 1420 and 1422 may be chosen to provide selected pressure drops so that the total pressure drop across the channel 1400 is substantially higher for fluids having viscosities or densities in a first range (such as fluids containing for water) and a substantially lower and constant pressure drop for fluids having viscosities or densities in a second range (such as fluids containing mostly oils). One or more bends may have an acute angle (less than 90 degrees). Simulation results show that for water, the pressure drop across a particular configuration of channel 1400 may be between 4.2 to 5.02 times the pressure drops across a straight pipe section.

In another aspect, the disclosure herein provides a method of determining the configuration of one or more flow channels for inflow devices that may provide substantially high pressure drop for fluids having viscosities or densities in a first range compared to the pressure drop for fluids having viscosities or densities in a second range. A set of fluid parameters is defined for a particular application, which parameters may include the flow rate or bulk volume desired for the inflow device, fluid viscosity and/or density ranges, etc. An initial set of parameters for an inflow device may then be selected or defined, which parameters, for example, may include one or more of: number of stages, surface area for each stage, stage geometries, offset between flow ports, axial travel distance for the fluid in each stage, angle of bend for the flow path, curvature of the flow paths, etc. A behavior of pressure drop versus viscosity of the fluid flowing through the specified ICD is determined using a computer system and a simulation model. The simulation may also be performed to provide pressure drops through each stage, fluid flow velocity patterns, reduction in effective flow areas along the fluid paths, etc. The results of the simulated or calculated pressure drops for different ranges of viscosities or densities may be compared to desired pressure drops. If the results differ more than an acceptable value, one or more initial parameters for the flow control device are altered and the simulation process repeated. This iterative process may be continued using new values of one or more inflow device parameters until a satisfactory pressure drop relationship is obtained. Alternatively, the relation ship between Reynolds number (Re) and coefficient of friction (K) may be determined at end of each simulation run to determine an inflow device configuration that will provide higher pressure drop for unwanted fluids, such as water, and a relatively constant pressure or laminar flow for certain other fluids, such as oils. The amount of turbulence induced along the fluid path in the inflow device, reduction in the effective flow areas along at ports or along bends, etc may be determined from flow velocity patterns and utilized to select parameters of the inflow device prior to each simulation run. The exemplary channels for flow control devices are described herein as axially placed channels in a tubular. However, such and other channels made according the teachings herein may be placed radially, helically or along any other angle. Additionally, such flow control devices may utilize different types of channels in a single device.

Thus, in one aspect, the disclosure herein provides an apparatus for controlling flow of fluid between a reservoir and a wellbore, which apparatus in one embodiment may include a flow-through region configured to substantially increase value of a selected parameter relating to the flow flow-through region when a selected property of the fluid is in a first range and maintain a substantially constant value of the selected parameter when the selected property of the fluid is in a second range.

In another aspect, the flow control device may include a flow-through region configured to substantially increase pressure drop across the flow-through region when a selected property of the fluid is in a first range and maintain a substantially constant pressure drop across the flow-through region when the selected property of the fluid is in a second range.

In another embodiment, the flow control device may include an inflow region, a flow-through and an outflow region, wherein the flow-through region is configured to substantially increase pressure drop when viscosity or density of the fluid is in a first range and maintain a substantially constant pressure drop when the viscosity or density of the fluid is in a second range. In one aspect, the first range may include viscosities less than 10 cP and the second range may include viscosities above 10 cP. Alternatively, the first range may include densities more than 8.33 lbs per gallon and the second range include densities less than 8.33 lbs per gallon. In one aspect, the flow-through region may be configured to induce selected amounts of turbulences in fluids having viscosities or densities in the first range to provide a desired pressure drop across the flow-through region for a given fluid flow rate through flow-through area. In another aspect, the flow-through region may include a structural area configured to receive the fluid via a first port and discharge the received fluid via a second port having a dimension "d", the structural area having an axial distance "x", there being an offset "h" between the first port and the second port. In one embodiment, h may be between 4 to 6 times d. In another embodiment h/x is greater than d/h. In another embodiment, the flow-through region may be configured to include a tortuous path.

In anther aspect, the disclosure provides a flow control device that may include: a flow-through region including a structural flow area, an inflow opening and an outflow opening, wherein the structural flow area, a fluid flow path in the structural flow area between the inflow opening and the outflow opening, tortuosity of the fluid flow path and size of the outflow opening are selected so that value of a fluid performance co-efficient ("K") is substantially greater for fluids having low Reynolds number ("Re)" in a first range compared to fluids having high Re in a second range.

In another aspect, a method is provided that may include: defining a flow rate for the fluid flow-through the inflow control device; selecting a geometry for the flow-through region formed on a tubular member, the flow-through region including an inlet, an outlet and a flow path between the inlet and the outlet configured to induce turbulence in the flow of the fluid between the inlet and the outlet sufficient to reduce an effective flow area through the outlet to cause a pressure drop across the outlet that is substantially greater for fluids having viscosity or density in a first range compared to fluids having a viscosity or density in a second range for the defined flow rate; and forming the tubular member having the selected geometry.

In yet another aspect, a computer-readable medium is provided that is accessible to a processor for executing instruction in a program embedded in the computer-readable medium, which program may include: (a) instructions to access a flow rate for a fluid flow control device; (b) instructions to access a first geometry for a flow-through region of the inflow control device formed on a tubular member, the flow-through section including an inlet, an outlet and a tortuous path between the inlet and the outlet configured to induce turbulence in the flow of the fluid between the inlet and the outlet sufficient to reduce the effective flow area through the outlet to cause a pressure drop across the outlet that is substantially greater for fluids having viscosity or density in a first range compared to fluids having a viscosity or density in a second range for the defined flow rate; (c) instructions to compute pressure drops across the outlet based on the first geometry corresponding to a plurality of fluid viscosities or fluid densities; (d) instructions to compare the computed pressure drops corresponding to the first range and the second range to desired values; (e) instructions to repeat steps c and d using one or more additional geometries until the computed pressure drops are within acceptable values; and (e) instructions to store a geometry having pressure drops that meet the desired values.

It should be understood that FIGS. 1-14 are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. A method of providing a flow control device for controlling flow of fluid between a formation and a wellbore, comprising:

defining a flow rate of the fluid through the flow control device;

defining a desired relationship between a pressure parameter of the flow control device and a selected property of the fluid, wherein the pressure parameter exhibits a substantial change when the selected property of the fluid is in a first range and remains substantially constant when the selected fluid property is in a second range;

determining using a computer and a simulation program a simulated relationship between the pressure parameter and the selected fluid property over the first range and the second range for the defined flow rate for a geometry of a flow through area of a flow control device, the geometry of the flow through area comprising a structural flow area between an inlet and an outlet, wherein the structural flow area inhibits a flow of water and gas relative to a flow of hydrocarbons;

determining a difference between the simulated relationship and the desired relationship of the pressure parameter and selected fluid property;

altering the geometry of the flow through area to a new geometry when the determined difference between the desired relationship and the simulated relationship is outside a desired range;

determining using the computer and the simulation program the relationship between the pressure parameter and the selected property over the first range and the second range for the defined flow rate for the new geometry of the flow through area of the flow control device;

repeating the steps of altering the geometry and determining the simulated relationship until the difference between the desired relationship and the simulated relationship for the new geometry is within the desired range; and storing the geometry of the flow through device for which the difference between the desired relationship and the simulated relationship is within the desired range on a suitable storage medium.

2. The method of claim 1 further comprising making the flow control device having the geometry on a tubular member.

3. The method of claim 1, wherein the pressure parameter is pressure drop across the flow-through region and the selected fluid property is one of viscosity and density of the fluid.

4. The method of claim 3, wherein the first range includes one of: (i) viscosities below about 10 cP; and (ii) densities above about 8.33 lbs per gallon.

5. The method of claim 1, wherein the first range corresponds to fluids containing water or gas and the second range corresponds to fluid containing mostly crude oils.

6. The method of claim 1, wherein the geometry of the flow-through region includes a tortuous path between an inlet for receiving the fluid and an outlet for discharging the received fluid, wherein the tortuous path induces turbulences in the fluid based on the water or gas content in the fluid that changes an effective area for a travel of the fluid proximate the outlet.

7. The method of claim 6, wherein a pressure drop across the tortuous path varies as a function of a property of the fluid in the first range.

8. The method of claim 6, wherein the tortuous path includes an acute bend and wherein a pressure drop proximate the acute bend changes as the value of the selected property of the fluid in the first range changes.

9. The method of claim 1, wherein the geometry of the flow-through region includes one of: a z-shaped fluid flow path; an s-shaped fluid flow path; and a fluid flow path that includes a circular path and an acute bend.

10. The method of claim 1, wherein the pressure parameter is a pressure loss coefficient that is a function of Reynolds number of the fluid.

11. The method of claim 1 further comprising selecting the geometry from a set of inflow device parameters.

12. A non-transitory computer-readable medium, accessible to a processor, having embedded thereon a computer program for executing instructions contained in the computer program, the computer program including:

a. instructions to access a flow rate for a fluid flow control device;

b. instructions to access a desired relationship between a pressure parameter of the flow control device and a selected property of the fluid, wherein the pressure parameter exhibits a substantial change when the selected property of the fluid changes is in a first range and remains substantially constant when the selected property of the fluid is in a second range;

c. instructions to use a simulation program to determine a simulated relationship between the pressure parameter and the selected property of the fluid over the first range and the second range for the defined flow rate for a geometry of a flow through area of a flow control device, the geometry of the flow through area comprising a structural flow area between an inlet and an outlet, wherein the structural flow area inhibits a flow of water and gas relative to a flow of hydrocarbons;

d. instructions to determine a difference between the simulated relationship and the desired relationship of the pressure parameter and selected fluid property;

e. instructions to alter the geometry of the flow through area to a new geometry when the determined difference between the desired relationship and the simulated relationship is outside a desired range;

f. instructions to repeat steps c, d and e using the new geometry of the flow-through region until the difference between the simulated relationship and the desired relationship is within the desired range; and g. instructions to store the geometry of the flow-through region that corresponds to the results of step e.

13. The non-transitory computer-readable medium of claim 12, wherein the pressure parameter is pressure drop across the flow-through region and the selected property of the fluid is one of viscosity and density of the fluid.

14. The non-transitory computer-readable medium of claim 12, wherein the first range includes one of: (i) viscosities below about 10 cP; and (ii) densities above about 8.33 lbs per gallon.

15. The non-transitory computer-readable medium of claim 12, wherein the first range corresponds to fluids containing water or gas and the second range corresponds to fluid containing mostly crude oils.

16. The non-transitory computer-readable medium of claim 12, wherein the geometry of the flow-through region includes a tortuous path between an inlet for receiving the fluid and outlet for discharging the received fluid, wherein the tortuous path induces turbulences in the fluid based on the water or gas content in the fluid that changes an effective area for a travel of the fluid proximate the outlet.

17. The non-transitory computer-readable medium of claim 16, wherein the pressure drop across the tortuous path varies as a function of the property of the fluid in the first range.

18. The non-transitory computer-readable medium of claim 17, wherein the tortuous path includes an acute bend and wherein the pressure drop proximate the acute bend changes as a value of the selected property of the fluid in the first range changes.

19. The non-transitory computer-readable medium of claim 12, wherein the geometry of the flow-through region includes one of: a z-shaped fluid flow path; an s-shaped fluid flow path; and a fluid flow path that includes a circular path and an acute bend.

* * * * *